US006141912A

United States Patent [19]

Graham et al.

[11] Patent Number: 6,141,912

[45] Date of Patent: Nov. 7, 2000

[54] WINDOW GUARD

[75] Inventors: James A. Graham, West Brookfield; Charles Flanagan, Worcester, both of Mass.

[73] Assignee: Automatic Specialties, Inc., Marlborough, Mass.

[21] Appl. No.: 09/259,818

[22] Filed: Mar. 1, 1999

[51] Int. Cl.[7] ..... E05C 21/02

[52] U.S. Cl. ..... 49/465; 49/57

[58] Field of Search ..... 49/463, 465, 57, 49/55; 403/329, 326, 109.3, 109.2, 231

[56] References Cited

U.S. PATENT DOCUMENTS

| | | | |
|---|---|---|---|
| 1,844,410 | 2/1932 | Schalk | 403/327 |
| 3,426,367 | 2/1969 | Bradford | 403/329 |
| 4,653,226 | 3/1987 | Woodrow | 49/57 |
| 4,671,012 | 6/1987 | Merklinger et al. | 49/57 |
| 4,817,334 | 4/1989 | Badger et al. | 49/55 |
| 5,007,200 | 4/1991 | Londono | 49/57 |
| 5,018,302 | 5/1991 | Kluge | 49/55 |
| 5,339,567 | 8/1994 | Pierpont et al. | 49/57 |
| 5,590,974 | 1/1997 | Yang | 403/329 |
| 5,779,386 | 7/1998 | Eichhorn | 403/109.3 |
| 5,916,074 | 6/1999 | Tracy | 49/55 |

OTHER PUBLICATIONS

Automatic Specialties, Inc., "Guardian Angel™ Window Guard"; Marlborough, Massachusetts, 1997.

*Primary Examiner*—Blair M. Johnson
*Assistant Examiner*—Curtis A. Cohen
*Attorney, Agent, or Firm*—Richard P. Crowley

[57] ABSTRACT

A window guard for a window opening to prevent a child or animal from passing through a window. The window guard includes side frames fastened to the sides of a window frame and a plurality of spaced-apart, transverse, tubular, width-adjustable crosspiece elements to form a grid pattern between the side supports to prevent passage of a child or animal. The crosspiece elements include user-removable, tension-biased, locking clips at each end, to lock the crosspiece elements in a locking position, but to permit easy removal, when required.

19 Claims, 3 Drawing Sheets

WINDOW GUARD

BACKGROUND OF THE INVENTION

Window guards comprised of transversely, spaced-apart, aluminum or steel bars are typically installed in the bottom half of a double hung window in order to prevent small children or animals from falling from the window. Typically, window guards are designed and tested to withstand about 150 pounds of pressure. Further, they are usually recommended for installation in windows located on the second story and above of a building and usually permanently installed, but must not be installed in any emergency or fire escape window.

Government agencies often recommend the use of operable window guards, in particular, window guards with a release feature which allow them to be released and removed from the inside without the use of separate tools, keys, or excessive force, so as to permit escape in the event of an emergency.

Window guards are not burglar or security guards. The bars employed are designed only to prevent a child from slipping through, but are not designed to protect against an intruder. Where window guards are not employed, a window may be installed with a window lock which may be used to restrict the window from opening more than a defined height.

Therefore, while window guards are often not required by law, the installation of window guards is voluntary and often employed by families with young children.

One window guard, known as the GUARDIAN ANGEL™ (a trademark of Automatic Specialties, Inc. of Marlborough, Mass.), provides for a pair of hinged panels with each side hinged to one side of the window frame. The panels are formed of spaced-apart, aluminum bars which swing to the center, and which panels overlap at the center. The window guard contains a release feature which allows escape in an emergency and employs a pair of aligned clips, with a hairpin-type clip securing the clips together, so that the overlapping center of the panels are secured together at the top and bottom, but may be easily removed by squeezing the clips together and removing the clips. The clips, with holes in them, are designed to fit on either side of the overlap panels in the center and are designed to be secured together with a hairpin-type clip.

It is desirable to provide for a new and improved window guard which is easily adjustable and lockable in place and may be easily removed, as desired, with a simple release mechanism.

SUMMARY OF THE INVENTION

The invention relates to an adjustable, removable window guard for a framed opening. The invention includes an adjustable, lockable, releasable, window guard for a framed opening which is easily installed and may be easily removed in an emergency.

The window guard of the invention prevents the passage of small children or animals through a window opening defined by a window frame, which window guard comprises a first and a second longitudinal side support element, each characterized by a plurality of spaced-apart, crosspiece-receiving holes; a fastener means to fasten the side support elements in a spaced-apart, aligned arrangement to a window frame; a plurality of crosspiece elements to form a selected, spaced-apart, child or animal-barrier across the window opening; the crosspiece elements each comprised of a pair of tubular elements having a one open end and another open end, and which ends snugly fit within the crosspiece-receiving holes, and which are slidably adjustable within one another to permit transverse width adjustment, by a user, to a selected frame or window opening. The window guard also comprises a plurality of tension-biased, locking clips within the one open end, the other open end, or both open ends of the crosspiece elements, the locking clips adapted to move by finger pressure of an adult user between a locking position wherein the one end, the other end, or both ends, of the crosspiece elements are locked into the crosspiece-receiving holes of the side support elements, and an unlocked position wherein the one end, the other end, or both ends of the crosspiece elements may be removed by a user from the side support elements and from the window opening.

The window guard comprises first and second longitudinal side support elements, e.g., box-shaped, which are characterized by and include fastener holes, so that fasteners may be used to secure the support elements to the side frames of the window or other opening. The side support elements include a plurality of spaced-apart, longitudinal, aligned, crosspiece-receiving holes therein about or just slightly larger than the diameter of the crosspiece elements.

The window guard includes a plurality of, typically 3 or 4 spaced-apart, generally parallel, rod or particularly tubular, transverse, crosspiece elements to form a selected grid or rack pattern, as desired, across the window or frame opening and between the support elements. The crosspiece elements are releasably secured at one or both ends to the side support elements.

In one embodiment, the crosspiece elements comprise a one and the other tubular element which are slidably adjustable within one another, so that a user may transversely adjust the width of the tubular elements to the frame or window opening width. The tubular crosspiece elements are characterized by open ends which are adapted with a locking clip, and which ends fit into the crosspiece-receiving hole in the side support elements secured to the frame, and a pair of spaced-apart, transverse clip holes, adjacent each end of the open ends of the tubular elements, to retain the snap-fit locking clip.

The window guard includes tension-biased locking clips adapted to be operated by a user from within a building and adapted to be placed within open ends of the tubular crosspiece elements. The locking clip is designed to be moved, by finger pressure on an inner finger or projection, between a locked position wherein the crosspiece elements are secured in place to the support elements, and a release or nonuse position, by the application of sufficient finger pressure to the internal raised finger of the tension-biased locking clip, to depress both of the indents, so that the crosspiece elements may be removed at each end from the support frames, to permit unrestricted access to the opening.

The tension-biased locking clip means is arranged to snap-fit into clip holes. The clip includes tension-biased, raised, spaced-apart, first and second fingers extending from one side of a bent, hairpin-type, loop clip and constructed and arranged to snap-fit into the clip holes within the one end of the crosspiece element. The raised fingers in the locked position are on either side of crosspiece-receiving holes in the support element, to secure each end of the tubular element to the support frame through the side support element.

Thus, the clip provides a means for securing the one, and preferably both ends, of the crosspiece tubular elements to the side support elements. In operation, the inner finger may be depressed to provide depression of the outer finger for slidable adjustable insertion into, or removal from, the open end of the tubular crosspiece elements from the support elements in the event of an emergency, so as to permit removal of the crosspiece elements which form the protective grid pattern.

Optionally, and preferably, the window guard includes a support rib, or preferably a plurality of spaced-apart support ribs, to support longitudinally the crosspiece elements in the selected grid pattern. The support rib may form an elongated oval or loop element and is slidably adjustable and secured to the crosspiece elements. The support ribs are usually secured to the larger tubular element and extend generally perpendicular to the crosspiece elements.

In one embodiment, the locking clip comprises a hairpin-type, bent wire, locking clip having two raised indents or fingers on one side and an elongated, open loop, biased element. The two indents are designed to fit with one on one side of the clip hole of the side support element, and with one on the other side of the side support element, to hold the ends of the tubular pieces in place. The locking clip is inserted by sliding it into the opening end of the tubular element, with the fingers aligned to snap-fit into the clip holes. The fingers in the snap-fit position extend upwardly on either side of the crosspiece-receiving holes of the side support elements, to lock in and prevent lateral movement of the crosspiece element in the locked grid pattern, while the end of the crosspiece element is supported by the side support elements. The locking clip is removed from the locking position by depressing one or both fingers, which permits sliding, lateral, inward movement of the crosspiece element. The locking clip typically comprises a heat-treated, spring temper steel wire.

The invention will be described for the purposes of illustration only in connection with certain embodiments; however, it is recognized that various changes, modifications, additions and improvements may be made in the described illustrations without departing from the spirit and scope of the invention.

DESCRIPTION OF THE EMBODIMENTS

Figure 1:
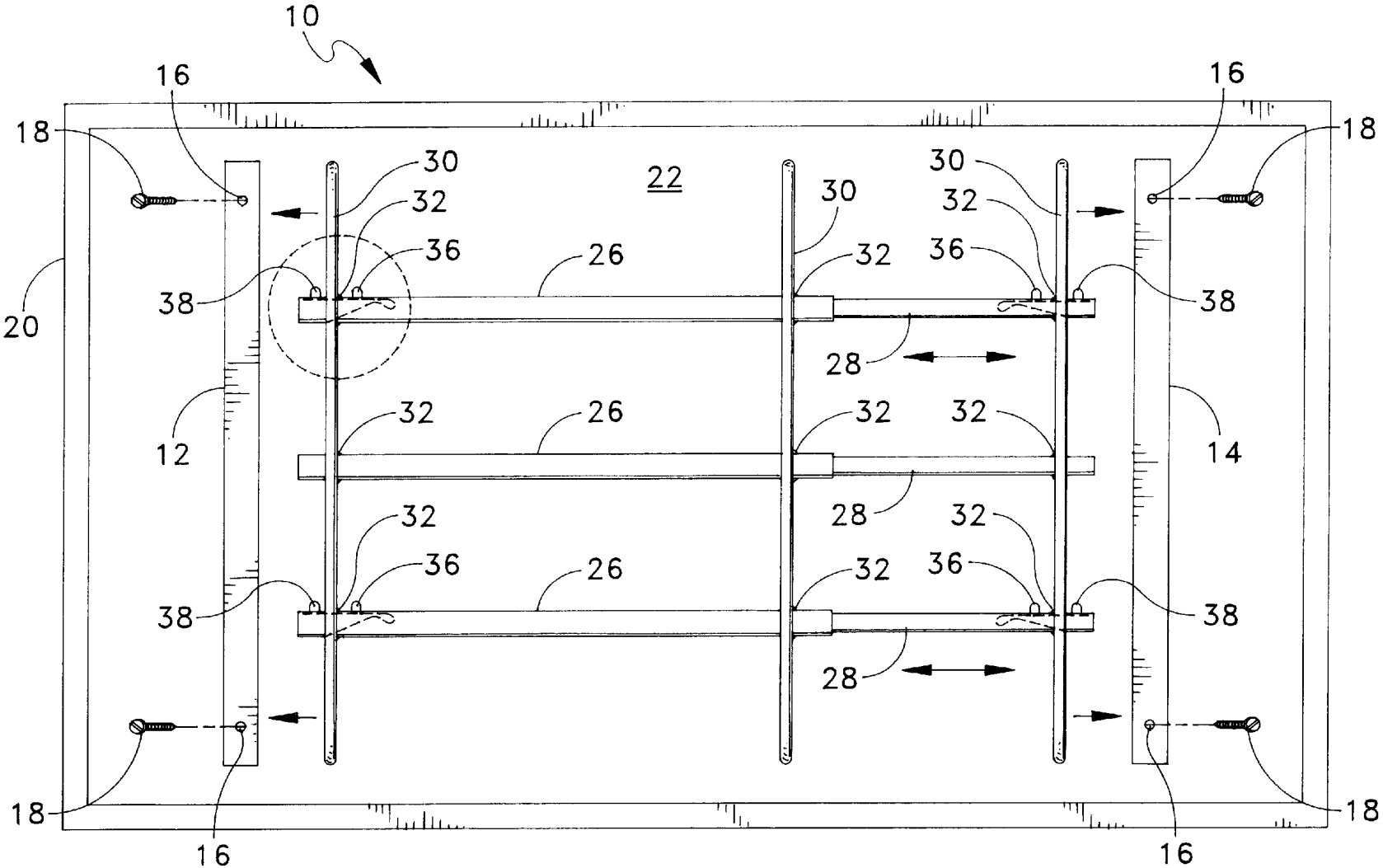
FIG. 1 is a front plan, partially exploded view of the window guard just prior to installation in a framed window opening with locking clips shown in dotted lines.
Figure 2:
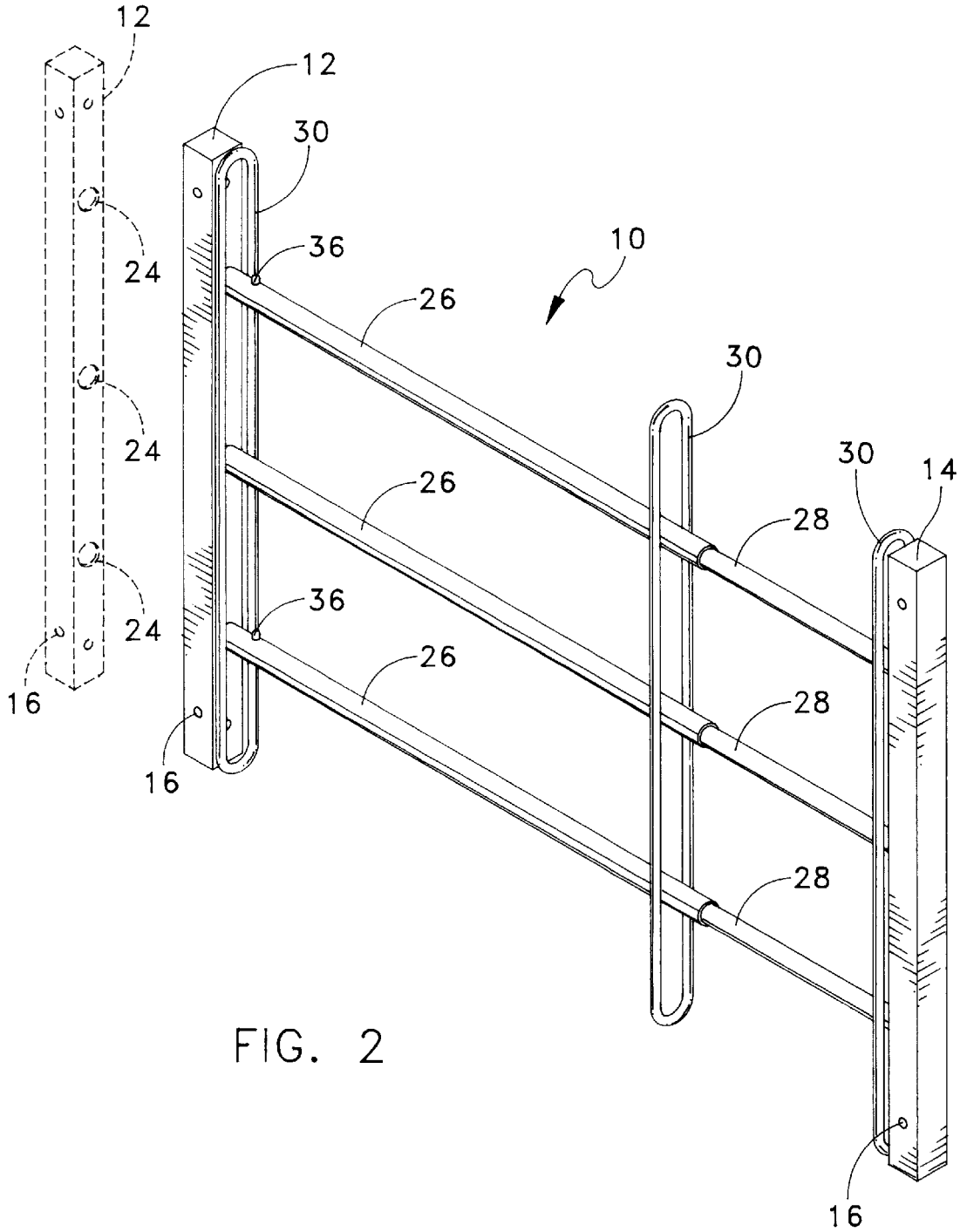
FIG. 2 is a perspective view from above of the window guard of FIG.1 with one side support shown in dotted lines.

The drawings of FIGS. 1 and 2 illustrate a window guard which is adjustable to fit openings, e.g., of 23 to 41 inches in width.

In reference to FIGS. 1 and 2, there is shown a window guard 10 of the invention with metal, hollow, box-shaped, side support elements 12 and 14, each with a plurality of selected fastener holes 16 to receive screws 18 to permit the side support elements 12 and 14 to be fastened opposingly to the side frames 20 of a window opening 22, in which the window guard is to be installed.

The side support elements 12 and 14 include spaced-apart, crosspiece-receiving holes 24 on the interior, dimensional side to receive and support the ends of the traverse, crosspiece elements comprised of tubular metal pieces 26 and 28, one piece fitting within the other, in a slidable adjustable manner, to permit a user to adjust the transverse length of the crosspiece elements, which together form a protective grid pattern for various size window openings.

The crosspiece elements are spaced-apart and positioned to form a selected grid pattern between the side supports 12 and 14 to provide a barrier sufficient in size to bar entry to a small child, for example, 3 to 6 inches apart. The crosspiece elements generally are parallel and may vary in number as described, e.g., 2 to 6.

The window guard 10 includes elongated oval or loop support ribs 30 comprised of tubular metal with the ends butt-welded together and spot welded 32 or otherwise secured to the crosspiece elements 26 and 28. The support ribs 30 are positioned to provide support for the crosspiece elements 26 and 28.

Figure 3:
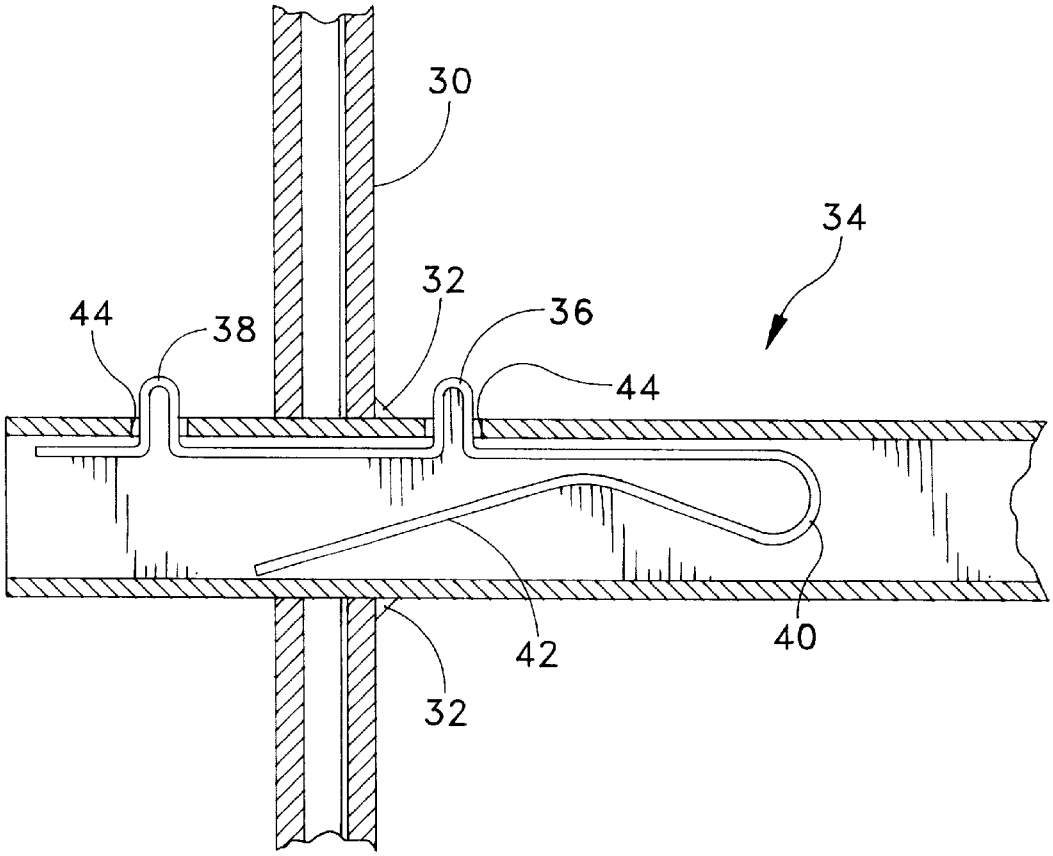
FIG. 3 is an enlarged, fragmentary, plan view of the locking clips used in the window guard with one shown within the dotted circle of FIG. 1.

The top and bottom adjustable crosspiece elements 26 and 28 include within each opposing open end, a locking clip 34 formed of bent wire (see particularly FIG. 3) which includes spaced-apart fingers or indents 36 and 38, a loop bend 40, and an outward tension-biased leg 42.

The locking clip 34 is shown in dotted lines in FIG. 1 in a biased locking position within each end of the top and bottom crosspiece elements 26 and 28.

In use, the depression of the finger 36 permit the locking clip 34 to be slid into the tubular ends of 26 and 28 and snap-fitted into end holes 44 of the crosspiece elements 26 and 28. Depression of finger 36 releases the end of crosspiece elements 26 and 28 from side supports 12 or 14.

The ends of crosspiece elements 26 and 28 are inserted in crosspiece holes 24 in the side supports 12 and 14 and the indent or finger depressed and then released, so that the finger indents 36 and 38 straddle on each side of dimensional holes 24 and retain the ends of the top and bottom crosspiece elements 26 and 28 in a fixed, locked, window guard position, while the ends of the middle crosspiece elements 26 and 28 are in position within holes 24 at each end.

The embodiment illustrated shows locking clip 34 in the open ends of the top and bottom crosspiece elements 26 and 28; however, it is recognized that the locking clips 34 may be used in all crosspiece elements 26 and 28, as described.

Further, the locking clips 34 may be used only at one end of a crosspiece element, with the other end of the crosspiece element retained in the crosspiece-receiving holes 24 of the side support elements 12 and 14. In this embodiment, the user would only need to depress the locking clips 34 at one end, to unlock one end of the crosspiece elements, and permit the user to slide the crosspiece elements 26 and 28 inwardly to a shorter width, and to remove the crosspiece elements 26 and 28.

The arrangement, as described and illustrated, permits the easy installation of the window guard 10 with a transverse grid pattern of locked, supported crosspiece elements 26 and 28 between fixed side supports 12 and 14, but permits an adult user to remove easily the adjustable crosspiece elements 26 and 28, by finger depression, of the raised fingers or indents 36 and 38 at each end, and to slide the ends of the crosspiece elements 26 and 28 from the holes 24 to remove the crosspiece elements 26 and 28 from the guarded window or framed opening 22.

The window guard, as described, avoids the difficulties and problems associated with prior art window and opening guards and provides for easy removal of the locked grid pattern.

What is claimed is:

1. A window guard to prevent the passage of small children or animals through a window opening defined by a window frame, which window guard comprises:

a) a first and a second side longitudinal support element, each support element characterized by at least one crosspiece-receiving hole;

b) a fastener means to fasten the side support elements in a spaced-apart, opposing arrangement to the window frame;

c) a crosspiece element to form a child or animal-barrier across the window opening, and which crosspiece element comprises a plurality of tubular crosspiece elements which are transversely adjustable to permit width adjustment to the selected window opening; the tubular crosspiece elements having a one end and an other end, the one end fits snugly into said at least one crosspiece-receiving hole in the first support, and the other end fits snugly into said at least one crosspiece-receiving hole in the second support, the one end and the other end each characterized by locking clip-receiving holes; and d) a first locking clip and a second locking clip, the first locking clip within the one end of the crosspiece element, and the second locking clip within the other end of the crosspiece element, the locking clips adapted to move by the application of finger pressure between a locked position and an unlocked position, and wherein in the locked position, the one end and the other end are locked into the first and second crosspiece-receiving holes, respectively, and wherein in the unlocked position, the tubular crosspiece elements are transversely adjustable and removable from the first and second crosspiece-receiving holes.

2. The window guard of claim 1 wherein the side supports are characterized by a plurality of spaced-apart fastener holes to receive the fastener means and the fastener means comprises screws for use in said holes.

3. The window guard of claim 1 wherein the side support elements comprise elongated, hollow, side supports with the crosspiece-receiving holes positioned on an interior side of the side support.

4. The window guard of claim 1 wherein the locking clip includes a pair of raised fingers on a tension-biased spring clip, which fingers are adapted to snap-fit in the locking position into the clip-receiving holes, and on depression of one of the fingers, to move to the unlocked position.

5. The window guard of claim 4 wherein the raised fingers, in the locked position, are on either side of a crosspiece-receiving hole.

6. The window guard of claim 1 which includes a plurality of generally longitudinal, spaced-apart, support rib elements generally perpendicularly secured to the tubular crosspiece element.

7. The window guard of claim 6 wherein the support rib elements comprise an elongated loop element which extends on either side of the crosspiece element.

8. The window guard of claim 7 wherein the support rib elements are positioned at one and the other end of the crosspiece element and generally adjacent the side support elements.

9. The window guard of claim 1 which includes a plurality of generally parallel, spaced-apart, transverse said crosspiece elements.

10. The window guard of claim 1 wherein the tubular crosspiece elements are transversely slidably adjustable within each crosspiece element.

11. In combination, a building having a window frame to define a window opening and a window guard which comprises:

a) a first and a second side longitudinal support element, each support element characterized by at least one crosspiece-receiving hole;

b) a fastener means to fasten the side support elements in a spaced-apart, opposing arrangement to the window frame;

c) a crosspiece element to form a child or animal-barrier across the window opening, and which crosspiece element comprises a plurality of tubular crosspiece elements which are transversely adjustable to permit width adjustment to the selected window opening; the tubular crosspiece elements having a one end and an other end, the one end fits snugly into said at least one crosspiece-receiving hole in the first support, and the other end fits snugly into said at least one crosspiece-receiving hole in the second support, the one end and the other end each characterized by locking clip-receiving holes; and d) a first locking clip and a second locking clip, the first locking clip within the one end of the crosspiece element, and the second locking clip within the other end of the crosspiece element, the locking clips adapted to move by the application of finger pressure between a locked position and an unlocked position, and wherein in the locked position, the one end and the other end are locked into the first and second crosspiece-receiving holes, respectively, and wherein in the unlocked position, the tubular crosspiece elements are transversely adjustable and removable from the first and second crosspiece-receiving holes.

12. The window guard of claim 11 which includes a plurality of generally uniformly spaced-apart, generally parallel and perpendicular support rib elements secured to the crosspiece elements.

13. A window guard to prevent the passage of small children or animals through a window opening defined by a window frame, which window guard comprises:

a) a first and a second side longitudinal support element, each side support element characterized by a plurality of opposite crosspiece-receiving holes;

b) a fastener means to fasten the side support elements in a spaced-apart, opposing arrangement to a window frame;

c) a plurality of transverse, generally parallel, crosspiece elements to form a child or animal-barrier across the window opening, and which crosspiece elements comprise a plurality of tubular crosspiece elements which are transversely adjustable to permit width adjustment to the selected window opening; the tubular crosspiece elements each having a one end and an other end, the one end fits snugly into said crosspiece-receiving hole in said first support, and the other end fits snugly into said opposing, crosspiece-receiving hole in said second support, a plurality of the crosspiece elements having a one end and an other end, each characterized by a pair of locking clip-receiving holes; and d) a plurality of first, tension-biased locking clips and a plurality of second, tension-biased locking clips, each clip with spaced-apart raised fingers, the first locking clip within the one end of the crosspiece elements, and the second locking clip within the other end of the crosspiece elements, the locking clips adapted to move by the application of finger pressure between a locked position and an unlocked position, and wherein in the locked position, the one end and the other end are locked into the first and second crosspiece-receiving holes, respectively, wherein in the unlocked position, the tubular crosspiece elements are transversely adjustable and removable from the first and second crosspiece-receiving holes; and e) a plurality of generally perpendicular, support rib elements secured to the crosspiece elements, and which elements comprise an elongated loop which extends on either side of the crosspiece elements.

14. A window guard to prevent the passage of small children or animals through a window opening defined by a window frame, which window guard comprises:

a) a first side support element and a second side support element, each side support element having a plurality of crosspiece element-receiving holes;

b) a fastener means to fasten the side support elements in a spaced-apart, opposing arrangement to a window frame;

c) a plurality of spaced-apart, generally parallel, transverse crosspiece elements, the crosspiece elements transversely adjustable to form a child or animal-barrier across the window opening, and each crosspiece element having a one end and an other end, each end constructed and arranged to fit within opposite, crosspiece element-receiving holes; and d) a locking means positioned at the one and the other end of at least one crosspiece-receiving element, which locking means moves between a locked position and an unlocked position by a user employing finger pressure; and wherein, in the locked position, the one end and the other end of the crosspiece element is locked in a non-adjustable, transverse position to the side support elements; and in the unlocked position, the crosspiece element is transversely adjustable, and the one end and the other end is removable from the crosspiece element-receiving holes.

15. The window guard of claim 14 which comprises a plurality of longitudinal, spaced-apart, generally parallel, support rib elements, each secured to the crosspiece elements.

16. The window guard of claim 14 wherein the locking means is positioned within the one end and the other end of the crosspiece element.

17. The window guard of claim 16 wherein the locking means comprises a tension-biased spring clip.

18. The window guard of claim 14 wherein the crosspiece elements comprise slidably adjustable, tubular crosspiece elements.

19. The window guard of claim 14 wherein the crosspiece elements comprise an upper crosspiece element and a lower crosspiece element, each of which said upper and lower crosspiece elements include a locking means.

* * * * *